US009234450B2

(12) United States Patent
England et al.

(10) Patent No.: US 9,234,450 B2
(45) Date of Patent: Jan. 12, 2016

(54) WATER PUMP AND WATER PUMP SYSTEM AND METHOD

(75) Inventors: Roger D. England, Columbus, IN (US); Mike Abraham, Charleston, SC (US); Thomas M. Yonushonis, Columbus, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 949 days.

(21) Appl. No.: 13/052,980

(22) Filed: Mar. 21, 2011

(65) Prior Publication Data

US 2011/0280705 A1 Nov. 17, 2011

Related U.S. Application Data

(60) Provisional application No. 61/320,134, filed on Apr. 1, 2010.

(51) Int. Cl.

| | |
|---|---|
| ***F01P 3/20*** | (2006.01) |
| ***F04D 29/58*** | (2006.01) |
| ***F04D 9/02*** | (2006.01) |
| ***F04D 15/02*** | (2006.01) |

(52) U.S. Cl.

CPC . *F01P 3/202* (2013.01); *F04D 9/02* (2013.01); *F04D 15/0218* (2013.01); *F04D 29/58* (2013.01); *F01P 2031/36* (2013.01)

(58) Field of Classification Search

CPC ..... F04D 9/00; F04D 9/001; F04D 9/002; F04D 9/004; F04D 9/02; F04D 1/00; F04D 15/0218; F04D 15/0263; F04D 15/0281; F04D 29/58; F04D 29/586; F04D 29/5886; F01P 3/202; F01P 2031/36

USPC ..... 417/435, 313

See application file for complete search history.

(56) References Cited

U.S. PATENT DOCUMENTS

| | | | | |
|---|---|---|---|---|
| 2,100,365 | A * | 11/1937 | Stratton | 415/11 |
| 3,630,642 | A | 12/1971 | Osterman | |
| 3,684,406 | A | 8/1972 | Edwards | |
| 3,867,071 | A * | 2/1975 | Hartley | 417/211.5 |
| 3,959,971 | A | 6/1976 | Mekari | |
| 4,367,699 | A | 1/1983 | Evans | |
| 4,521,156 | A * | 6/1985 | Napolitano | 415/11 |
| 5,095,855 | A | 3/1992 | Fukuda et al. | |
| 5,100,298 | A | 3/1992 | Shibata et al. | |

(Continued)

FOREIGN PATENT DOCUMENTS

| | | |
|---|---|---|
| JP | 04-0005425 | 1/1992 |

OTHER PUBLICATIONS

Trickett Marine Products (TMP); Sea Water Cooling Pumps; www.tmp-rawwaterpumps-racorffilters.co.uk/KMP.html; Mar. 2, 2010.

*Primary Examiner* — Charles Freay
*Assistant Examiner* — Philip Stimpert
(74) *Attorney, Agent, or Firm* — Faegre Baker Daniels LLP

(57) ABSTRACT

This disclosure relates a water pump, a system for cooling internal combustion engine components including a water pump, and a method for operating an internal combustion engine including a water pump. The water pump, system and method provide protection of the pump impeller during dry pump operation, such as when a watercraft engine is started while the watercraft is out of water, by dispensing fluid from a reservoir to the pump's impeller chamber. The fluid enters the chamber via a controllable flow path and interacts with the impeller and chamber walls to cool and lubricate the impeller.

17 Claims, 2 Drawing Sheets

(56) References Cited

U.S. PATENT DOCUMENTS 6,481,390 B1 11/2002 Robb
6,513,463 B2 2/2003 Katayama
6,672,919 B1 1/2004 Beson
6,802,283 B2 10/2004 Liederman et al.

* cited by examiner

WATER PUMP AND WATER PUMP SYSTEM AND METHOD

FIELD OF THE INVENTION

The invention relates to a pump for providing fluid to cool components of an internal combustion engine, a system for cooling engine components, and a method for operating an internal combustion engine including a water pump.

BACKGROUND

Marine engines typically draw water from the operating environment to perform heat exchange with elements of a watercraft. For example, sea water can be drawn in via a seacock in the hull of a watercraft to cool engine components and provide air conditioning of the watercraft quarters. To create a sufficient flow of water for such applications, an engine crankshaft drives a raw water pump of an open loop system mounted on or near the engine to pump water directly through water jackets of the engine or through a heat exchanger including piping of a closed loop cooling system.

SUMMARY

A water pump, a system for cooling components of an internal combustion engine, and a method for operating an internal combustion engine are provided by the invention.

More particularly, embodiments consistent with the claimed invention relate to a raw water pump for an internal combustion engine. The raw water pump can include an impeller chamber having an impeller mounted on a rotatable shaft, an inlet in fluid communication with the impeller for supplying raw water at a first pressure to the impeller, an outlet in fluid communication with the impeller for outputting raw water at a second pressure higher than the first pressure. The pump can include a reservoir and a flow controller that controls the flow of fluid in the reservoir. Activation of the flow controller permits fluid communication between the impeller chamber and the reservoir.

In another aspect, a system for cooling internal combustion engine components can include a pump assembly for supplying water to cool the engine components. The pump assembly can include an impeller chamber containing an impeller coupled to a shaft rotatably drivable by an internal combustion engine crankshaft, a fluid inlet in fluid communication with the impeller chamber, and a fluid outlet in fluid communication with the impeller chamber. The system can include a reservoir in controllable fluid communication with the pump impeller chamber, and a flow controller configured to control the flow of liquid stored in the reservoir through a flow path between the reservoir and the impeller chamber to cool and lubricate the impeller in response to receiving a flow control signal.

Another aspect of the invention relates to a way to operate an internal combustion engine including a water pump. The operation method includes detecting a start signal indicating initiation of an engine ignition sequence and sensing presence of water at the inlet of the water pump. With the detection of a start signal and the sensed presence indicating absence of water, fluid in a reservoir can be permitted to flow via a controllable flow path to an impeller chamber of the water pump fluidly connected to the reservoir. An impeller contained in the impeller chamber can be cooled and lubricated by the fluid entering the impeller chamber, and thus avoid damage from frictional forces resulting from dry pump operation. With the detection of a start signal and the sensed presence indicating that water is present at the inlet of the water pump, fluid in the reservoir is prevented from flowing from the reservoir to the impeller chamber.

It is to be understood that both the foregoing general description and the following detailed description are exemplary and exemplary only and are not restrictive of the invention, as claimed.

BRIEF DESCRIPTION OF THE DRAWINGS

The accompanying drawings, which are included to provide a further understanding of the invention and are incorporated in and constitute a part of this specification, illustrate embodiments of the invention that together with the description serve to explain the principles of the invention. In the drawings.

DETAILED DESCRIPTION

Figure 1:
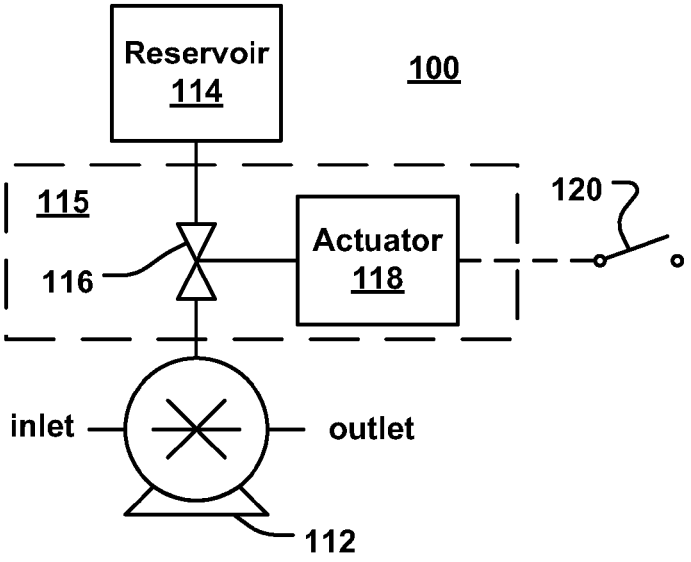
FIG. 1 is a schematic diagram of a system including a water pump, a reservoir, and a fluid flow controller according to an exemplary embodiment.

The various aspects are described hereafter in greater detail in connection with a number of exemplary embodiments to facilitate an understanding of the invention. However, the invention should not be construed as being limited to these embodiments. Rather, these embodiments are provided so that the disclosure will be thorough and complete, and will fully convey the scope of the invention to those skilled in the art. Descriptions of well-known functions and constructions are omitted for clarity and conciseness. Further, it should be emphasized that the terms "comprises" and "comprising," when used in this specification, are taken to specify the presence of stated elements, features, integers, steps or components; but the use of these terms does not preclude the presence or addition of one or more other elements, features, integers, steps, components or groups thereof.

Many aspects of the invention are described in terms of sequences of actions to be performed by elements of a computer system or other hardware capable of executing programmed instructions, such as a control module, controller or other device responsive to receiving a signal. It will be recognized that in each of the embodiments, the various actions could be performed by specialized circuits (e.g., discrete logic gates interconnected to perform a specialized function), by program instructions, such as program modules, being executed by one or more processors (e.g., a central processing unit (CPU) or microprocessor), or by a combination of both. Logic of embodiments consistent with the claimed invention can be implemented with any type of appropriate hardware and/or software, with portions residing in the form of computer readable storage medium with a control algorithm recorded thereon such as the executable logic and instructions disclosed herein, and can be programmed, for example, to include one or more look-up tables and/or calibration parameters. The computer readable medium can comprise a random access memory (RAM), a read-only memory (ROM), an erasable programmable read-only memory (EPROM or Flash memory), an optical fiber, and a portable compact disc read-only memory (CD-ROM), or any other solid-state, magnetic, and/or optical disk or other tangible medium capable of storing information. Thus, various aspects can be embodied in many different forms, and all such forms are contemplated to be consistent with the scope of the claimed invention.

There are a number of situations in which it is desirable to run an engine of a marine vessel (watercraft) while the watercraft is out of water. For example, maintenance of a watercraft can require running the watercraft engine while the watercraft is trailered, lifted from water, on the deck or davit of a larger vessel, or placed in dry dock. Other situations in which it can be desirable to start a watercraft engine and quickly brought into operational mode before placing the watercraft in water include military applications that tender a boat on a ship prior to dropping it in the water, particularly in battle situations, or search and rescue deployments. For instance, starting a watercraft engine while the watercraft is attached to a ship's davit allows the engine can reach operational temperature before it is lowered into the water, which more efficiently utilizes time between an order and deployment, and thus facilitates more rapid deployment of the watercraft.

At the same time, starting a watercraft engine while the watercraft is out of water would cause an impeller of the engine's water pump to spin in a dry state because water would not be available at the inlet of the pump inlet. While a typical impeller can withstand a limited amount of dry spinning, an extended amount of dry running time would cause the impeller to eventually fail. For example, it can take more than twenty minutes at idle for coolant in a closed loop cooling system of a diesel engine to attain operating temperature. A typical sea water impeller running for this amount of time would be destroyed after about five minutes. At rated engine speed, an impeller would fail after about ninety seconds. The water pump, system and method described herein permit a watercraft engine to drive a water pump without water available at the pump inlet for an extended period of time without damaging the water pump's impeller.

FIG. 1 shows an exemplary system 100 according to an embodiment. As shown in FIG. 1, a water pump 112 is connected to a reservoir 114 via a flow controller 115. The flow controller 115 includes a valve 116 and an actuator 118. The valve 116 is electrically connected to the actuator 118, which controls the valve 116 based on a signal provided by a switch 120. When the switch 120 is closed, fluid contained in the reservoir 114 is allowed to flow into a chamber of the water pump 112 containing the pump impeller.

The reservoir 114 is capable of holding liquid, for example, water, and can be suitably sized according to required volume and/or specific application. The reservoir 114 can be provided as a part of the water pump 112 or separate from the pump. The valve 116 can be integrated with the reservoir 114 or the water pump 112, or provided separate from the reservoir and water pump 112, but fluidly connected to the reservoir 114 via a line. Valve 116 can be any type of mechanism that can regulate and/or meter the flow of fluid from the reservoir 114 to the chamber of the water pump 112, such as a gate valve, a ball valve, a clamp etc. that can be controlled by energizing the actuator 118. The actuator can be a solenoid, motor or other suitable mechanism or device that can control the release of fluid from the reservoir 114. While FIG. 1 shows the control switch 120 as having either an on state or an off state, it is to be understood that other types of switches can be used, for example, a multi-state switch that can be switched between plural states that cause the actuator to control the valve to dispense liquid into the water pump 112 at different respective rates.

In operation, the control switch 120 of the pump system 100 can be manually activated when it is desired to operate the engine while the watercraft is out of the water. The switch 120 can be installed anywhere on a watercraft. For example, the control switch 120 can be installed near the ignition switch at the helm, at the rear of the watercraft, near the engine, or at any other accessible position on the watercraft.

Figure 2:
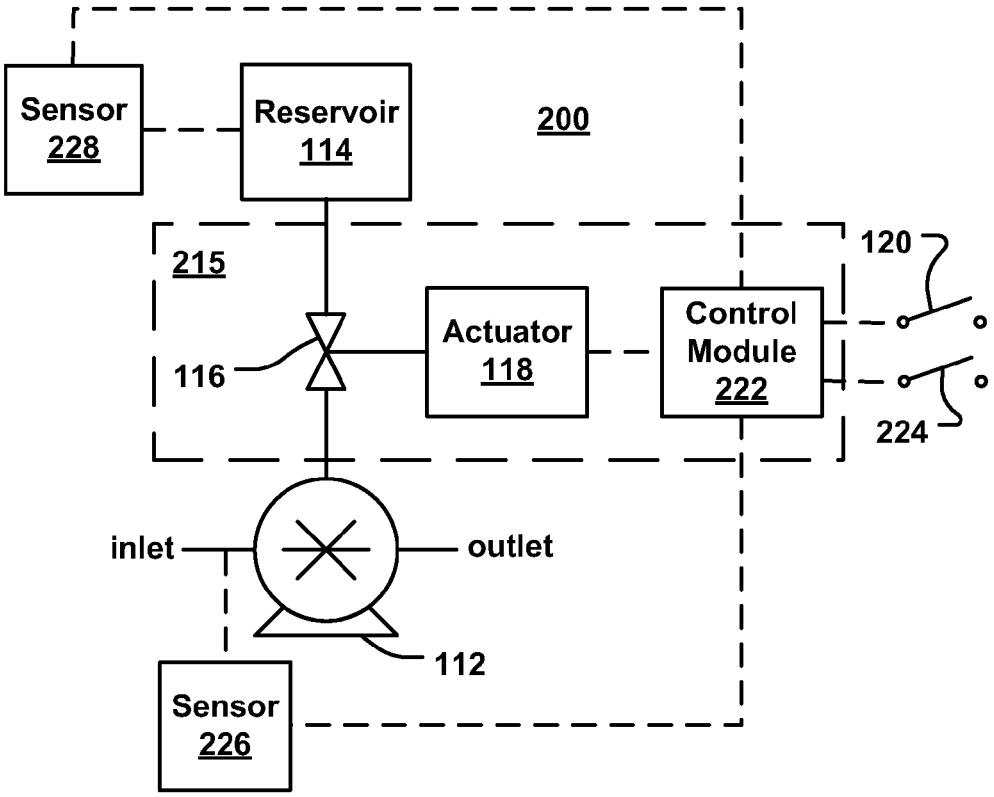
FIG. 2 is a schematic diagram of a system including a water pump, a reservoir, and a fluid flow controller according to an exemplary embodiment.

FIG. 2 shows a system 200 according to an exemplary embodiment. Items depicted having the same reference numbers as items in system 100 are described above. The system 200 includes a flow controller 215 having a control module 222, such as an engine control unit (ECU) or engine control module (ECM), an actuator 118, and a valve 116. The control module 222 can provide a flow control signal to the actuator 118 to control the valve 116 such that the valve 116 dispenses fluid from the reservoir 114 to the chamber of the water pump 112 containing the pump impeller (not shown) in an amount sufficient to cool and lubricate internal components of the water pump 112. The control module 222 also can receive a start signal from an ignition/start switch 224 and a water presence signal generated by water sensor 226 positioned at the inlet of the water pump 112. The control module 222 also can receive a signal from the manually operated control switch 120 to directly control the actuator 118 to in turn cause the valve 116 to dispense fluid into the water pump 112, although some embodiments can omit the manual control switch 120.

The control module 222 allows for flexibility in control of the actuator/valve 116/118. For instance, the control module 222 can acquire the engine speed and adjust an amount of water dispensed from the reservoir 114 accordingly. Additionally, the control module 222 can receive a signal from a water sensor 228, which is provided at the reservoir 114 to monitor whether water is present in the reservoir 114. With an insufficient amount of water in the reservoir 114, the control module provides this information via an indication to a user, for example, via an audible alarm or message, a gauge and/or a light (e.g., an LED indicator at the helm), when the user attempts to start the watercraft while out of water.

Figure 3A:
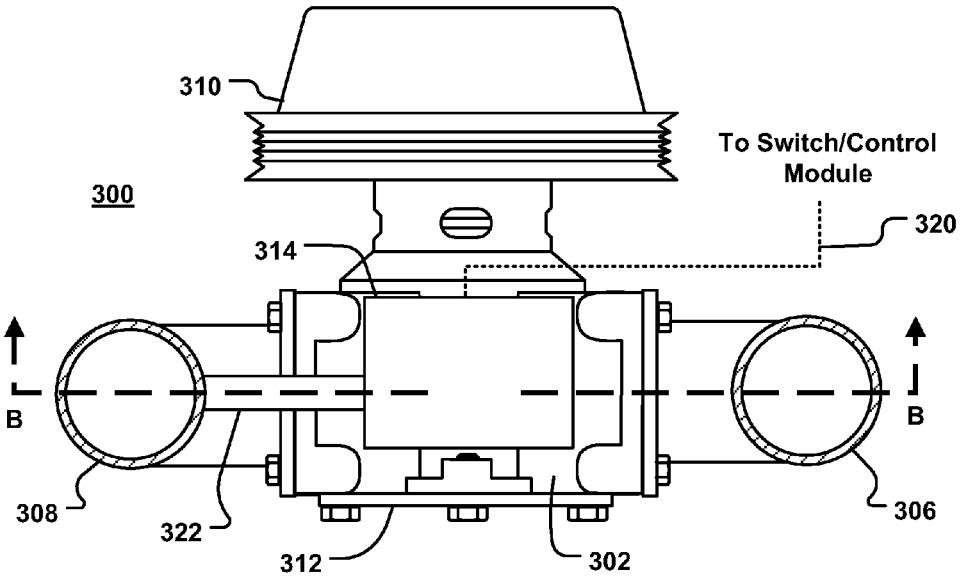
FIG. 3A is a top view diagram of a raw water pump according to an exemplary embodiment.
Figure 3B:
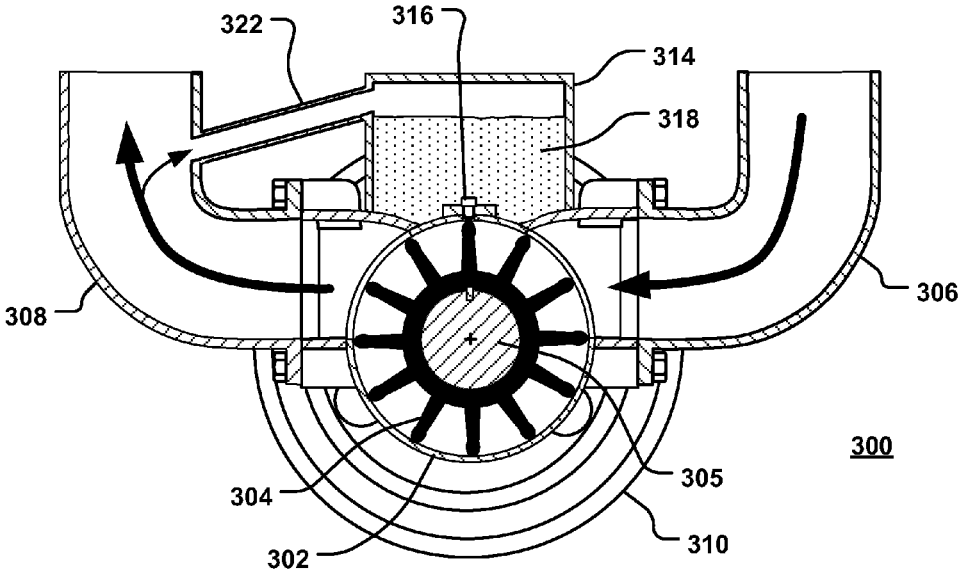
FIG. 3B is a diagram of a cross-sectional view of the raw water pump shown in FIG. 3A taken along line B-B.

FIGS. 3A and 3B respectively show a top view and side cross-sectional view of a water pump 300 according to an exemplary embodiment. The water pump 300 includes an impeller body 302 housing an impeller 304, which rotates on a shaft 305. A water inlet tube or pipe 306 is connected to one side of the impeller body 302, and a water outlet tube or pipe 308 is connected to an opposite side of the impeller body 302. On one side of the pump 300, a pulley 310 can be attached to an end portion of the shaft 305 to provide a surface for a belt to drive the impeller 304, although another driving component, such as a gear, shaft, or electric motor, can be used to drive the pump 300. The side of the pump 300 opposite the pulley 310 includes an access cover plate 312 sealingly enclosing the impeller body 302.

A reservoir 314 is provided in fluid connection the impeller body 302, with a valve 316 providing controllable opening a cooling and lubricating liquid 318, such as water, to enter into the impeller body 302 from the reservoir 314 under the control of an actuator (not shown). The actuator, in turn, can be controlled by a switch and/or control module (not shown) via line 320, which can be a bus including a power lines for the actuator 316 and one or more signal lines for water presence sensor at the pump inlet 306 (not shown), a water presence and/or level sensor in the reservoir 314 (not shown), and/or other devices. For example, the pump 30 can include a temperature sensor for monitoring a temperature of the impeller chamber. A fill tube 322 can be provided in fluid connection between the reservoir 314 and the pump outlet 308 to allow water exiting the pump outlet 308 to replenish the reservoir 314.

While not shown in FIGS. 3A and 3B, embodiments of a water pump 300 can include a resealable opening, such as a cap, on the reservoir 314 to allow for manually replenishing water 318 prior to starting or storing the watercraft while out of water. The reservoir also can be made of a corrosion resistant material (e.g., stainless steel or plastic), include cathodic protection, or be coated with a material to make it resistant to corrosive effects of the fluid remaining in the pump, for example, sea water.

The pump 300 can be attached to, mounted with, or otherwise driven by the engine crankshaft of a watercraft to pump water from the environment in which the watercraft operates. During normal operation in a marine environment, raw water, for example, salt water from a sea, ocean or bay or fresh water from a river, lake or pond, can enter through a seacock in the hull of the watercraft and thereafter enter the inlet 306 of the water pump 300. The turning crankshaft is coupled to the impeller 304, for example, using a belt, which causes the impeller 304 to rotate on the shaft 305. As the impeller 304 rotates, it pushes water at the pump inlet 306 through the impeller chamber 302 to the pump outlet 308 where it exits the pump 300 to channels downstream of the pump 300 to cool engine components, remove heat from a closed engine coolant system, and/or cool the engine exhaust. For example, pump 300 can pump water in an open loop system to pump water directly through water jackets of the engine or through a heat exchanger including piping of a closed loop cooling system. However, some water exiting the pump outlet 308 can be moved to the reservoir 314 through the fill tube 322 to maintain a volume of water in the reservoir while operating the watercraft. After the watercraft is turned off and removed from the water, liquid 318 present in the pump reservoir 314 will remain until it is released via activation of the valve 316.

As described above, starting a watercraft's engine while the watercraft removed from water results in the pump impeller running dry because there is no source of water at the pump inlet. As a result, frictional forces increase between the impeller, the impeller chamber and the impeller shaft and cause the impeller to eventually overheat and fail. To prevent such premature failure, embodiments described herein allow a cooling liquid 318 to enter and contact the impeller chamber 302 and the impeller 304 upon activation of the valve 316. The coolant 318 is introduced at a rate sufficient to interact with the impeller and impeller chamber to cool and lubricate these pump components and prevent damage to the impeller, at least as long as coolant is available to flow from the reservoir 314 to the valve 316.

In an embodiment, the valve 316 can be designed to allow a metered amount of cooling liquid to flow into the impeller chamber 302 at the lower end of an engine's operating speed range, such as idle speed. In other embodiments, the valve 316 can be controlled to allow fluid to flow at different rates in the flow path between the reservoir 314 and impeller chamber based on a detected engine speed and/or a pump temperature.

The invention facilitates starting marine vessel engines, such as tender boats, prior to dropping them in water. This can allow the marine vessel engine to reach operating temperature around the same time the boat is placed in water, and thus decrease time of deployment in time-sensitive military and rescue applications.

Although a limited number of embodiments is described herein, one of ordinary skill in the art will readily recognize that there could be variations to any of these embodiments and those variations would be within the scope of the appended claims. For example, some embodiments can include a coolant reservoir that is not integrated with the housing of the water pump. In these embodiments, a valve or other controlled dispensing device can be provided in fluid connection with a line, such as tubing, and the pump impeller chamber. This would allow for the reservoir to be positioned at nearly any position on the boat that would permit the coolant to flow into the pump. In other embodiments, the reservoir can include a cap for filling it with liquid and a vent to allow for proper pressure level within the reservoir. Additionally, embodiments can provide protection of water pump components while a watercraft is in water, but water flow to the pump inlet is obstructed. In such an application, a user can be alerted that an obstruction has occurred, and engine operation can safely continue for a limited amount of time.

Thus, it will be apparent to those skilled in the art that various changes and modifications can be made to the water pump, system for cooling internal combustion engine components, and method of operating an internal combustion engine described herein without departing from the scope of the appended claims and their equivalents.

What is claimed is:

1. A raw water pump for an internal combustion engine, comprising:

an impeller chamber including an impeller mounted on a rotatable shaft;

an inlet in fluid communication with the impeller for supplying raw water at a first pressure to the impeller;

an outlet in fluid communication with the impeller for outputting raw water at a second pressure higher than the first pressure;

a reservoir configured to contain a liquid; and a flow controller, wherein activation of the flow controller permits fluid communication between the impeller chamber and the reservoir and allows the liquid contained in the reservoir to flow into the impeller chamber when the impeller is running in a dry state without providing the liquid to the inlet, wherein when the impeller is running in the dry state, the flow controller allows the liquid to flow at a rate to cool and lubricate to inhibit damage to the impeller, the rate determined in response to at least one of a detected engine speed of the internal combustion engine and a temperature of the pump.

2. The raw water pump of claim 1, wherein the flow controller is positioned between the reservoir and the impeller chamber.

3. The raw water pump of claim 1, wherein the reservoir is integrated with the impeller chamber.

4. The raw water pump of claim 1, further comprising:

a channel fluidly connecting the outlet of the raw water pump with the reservoir, thereby permitting raw water from the outlet to enter the reservoir with operation of the pump.

5. The raw water pump of claim 1, wherein the flow controller comprises an actuator, and activation of said actuator controls said fluid communication between the impeller chamber and the reservoir.

6. The raw water pump of claim 5, further comprising a switch connected to the actuator and having at least an on and an off state, wherein with the switch in the on state, the actuator is activated to permit fluid communication between the impeller chamber and the reservoir.

7. The raw water pump of claim 1, wherein the flow controller is configured to permit a rate of fluid communication between the impeller chamber and the reservoir that increases with an increasing rotation speed of the rotatable shaft.

8. The raw water pump of claim 1, wherein the inlet includes a water presence sensor.

9. The raw water pump of claim 1, wherein the reservoir includes a water presence sensor.

10. The raw water pump of claim 1, wherein activation of the flow controller allows liquid contained in the reservoir to flow into the impeller chamber when water is unavailable at the inlet.

11. A system for cooling components of an internal combustion engine, comprising:

a pump assembly for supplying water to cool the engine components, said pump assembly including:

an impeller chamber containing an impeller coupled to a shaft rotatably drivable by an internal combustion engine crankshaft, the impeller chamber including at least a first port, a second port, and a third port;

a fluid inlet in fluid communication with the impeller chamber via the first port; and a fluid outlet in fluid communication with the impeller chamber via the second port;

a reservoir in controllable fluid communication with the impeller chamber via the third port; and a flow controller configured to control the flow of a liquid stored in the reservoir through a flow path between the reservoir and the second port of the impeller chamber to cool and lubricate the impeller in response to receiving a flow control signal, wherein the flow controller allows the liquid stored in the reservoir to flow into the impeller chamber when the impeller is running in a dry state, wherein when the impeller is running in the dry state, the flow controller allows the liquid to flow at a rate to cool and lubricate to inhibit damage to the impeller, the rate determined in response to at least one of a detected engine speed of the internal combustion engine and a temperature of the pump assembly.

12. The system of claim 11, wherein the flow control device comprises:

a valve positioned in the fluid flow path between the reservoir and the impeller chamber;

a control device connected to the valve, said control device is configured to receive said signal and control said valve based on the received signal.

13. The system of claim 12, wherein the control device is an actuator.

14. The system of claim 11, further comprising a water presence sensor positioned at the inlet of the pump, and the flow control signal received by the flow controller is based on whether an output of the water presence sensor indicates water is present at the inlet of the pump.

15. A system for cooling components of an internal combustion engine, comprising:

a pump assembly for supplying water to cool the engine components, said pump assembly including:

an impeller chamber containing an impeller coupled to a shaft rotatably drivable by an internal combustion engine crankshaft;

a fluid inlet in fluid communication with the impeller chamber; and a fluid outlet in fluid communication with the impeller chamber;

a reservoir in controllable fluid communication with the pump impeller chamber;

a flow controller including a control module structured to provide a flow control signal, the flow controller configured to control the flow of liquid stored in the reservoir through a flow path between the reservoir and the impeller chamber to cool and lubricate the impeller in response to the flow control signal; and a water presence sensor positioned at the inlet of the pump, and the flow control signal being provided in response to whether an output of the water presence sensor indicates water is present at the inlet of the pump, wherein when the impeller is running in the dry state, the flow controller controls the liquid to flow at a rate to cool and lubricate to inhibit damage to the impeller, the rate determined in response to at least one of a detected engine speed of the internal combustion engine and a temperature of the pump assembly.

16. The system of claim 11, further comprising a water presence sensor positioned at the reservoir to output a signal indicating whether fluid is present in the reservoir, and the flow controller is configured to generate a warning signal if the outputted signal indicates no fluid is present in the reservoir.

17. The system of claim 11, wherein the flow controller allows a liquid contained in the reservoir to flow into the impeller chamber when water is unavailable at the fluid inlet.

* * * * *